US011325620B2

(12) United States Patent
Roy et al.

(10) Patent No.: US 11,325,620 B2
(45) Date of Patent: May 10, 2022

(54) PORTABLE ROPE TOW ASSEMBLY

(71) Applicant: Towpro Lifts, LLC, Turner, ME (US)

(72) Inventors: Kyle Deane Roy, Lee, NH (US); William W. Mayo, Augusta, ME (US)

(73) Assignee: Towpro Lifts, LLC, Fremont, NH (US)

( * ) Notice: Subject to any disclaimer, the term of this patent is extended or adjusted under 35 U.S.C. 154(b) by 222 days.

(21) Appl. No.: 16/742,049

(22) Filed: Jan. 14, 2020

(65) Prior Publication Data

US 2020/0223456 A1 Jul. 16, 2020

Related U.S. Application Data

(60) Provisional application No. 62/918,118, filed on Jan. 15, 2019.

(51) Int. Cl.
*B61B 11/00* (2006.01)

(52) U.S. Cl.
CPC ..... *B61B 11/002* (2013.01)

(58) Field of Classification Search
CPC ..... B61B 11/00; B61B 11/002
See application file for complete search history.

(56) References Cited

U.S. PATENT DOCUMENTS

| | | | | |
|---|---|---|---|---|
| 3,739,728 | A | 6/1973 | Thompson | |
| 3,779,171 | A | 12/1973 | Littlehorn | |
| 4,023,502 | A | 5/1977 | Eising | |
| 4,920,892 | A | 5/1990 | Pesek | |
| 5,205,219 | A | 4/1993 | Groskreutz et al. | |
| 6,295,936 | B1 | 10/2001 | Dahlstrom | |
| 8,746,148 | B1 | 6/2014 | Niedermeyer | |
| 2003/0047107 | A1 | 3/2003 | Thomas | |
| 2012/0187355 | A1 | 7/2012 | Mehrkens | |
| 2013/0213255 | A1 * | 8/2013 | Von Lerchenfeld | B61B 11/00 104/173.2 |
| 2017/0120934 | A1 * | 5/2017 | Aramburo | B66D 1/50 |

FOREIGN PATENT DOCUMENTS

| | | | | |
|---|---|---|---|---|
| DE | 102016224363 B3 * | 3/2018 | | B61B 11/00 |
| WO | WO-2009015878 A2 * | 2/2009 | | B61B 11/00 |

OTHER PUBLICATIONS

International Search Report and Written Opinion dated Apr. 21, 2020 in co-pending PCT Application PCT/US2020/013450.

* cited by examiner

*Primary Examiner* — Zachary L Kuhfuss
(74) *Attorney, Agent, or Firm* — Andrus Intellectual Property Law, LLP

(57) ABSTRACT

A portable rope tow assembly is used to transport people, typically skiing or snowboarding, along snow covered ground and usually up hill. The assembly is extremely lightweight, portable and rapid to deploy. It uses a variable frequency drive to control an electric drive motor, and enables convenient variable speed and reverse direction operation.

20 Claims, 11 Drawing Sheets

PORTABLE ROPE TOW ASSEMBLY

FIELD OF THE INVENTION

The present application relates to a portable rope tow assembly device primarily used for transporting skiers, snowboarders, tubers or other people involved in snow-related activities up inclines that otherwise would be difficult, or time-consuming, to traverse on foot.

BACKGROUND OF THE INVENTION

Many prior art rope tow devices are large, bulky, permanent or semi-permanent fixtures employed near the bottom of small hills used for new or beginner level skiers and snowboarders. As such, they tend to transport skiers relatively slowly up the incline. Other prior art rope tow devices are designed to be temporary and portable. These portable prior art systems use gasoline engines, are loud, and typically require many people and a great deal of effort to set-up and secure for safe operation. As such, there has not been a significant commercial market for these portable gasoline rope tow systems. Another drawback with these gasoline systems is that they typically operate at a constant speed, which may be too slow for some situations and too fast for other applications.

For temporary applications such as sporting events, exhibitions, or competitions, there remains a need for a lightweight, portable rope tow device that can be set up quickly, is robust and reliable, emits low noise during operation, and capable of transporting users uphill at a controllable rate.

SUMMARY OF THE INVENTION

The invention is a portable rope tow assembly having a portable drive unit with an electric motor and an electric power converter comprising a variable frequency drive. The assembly also includes a return unit. The transport rope is looped continuously around drive pulleys and idlers pulleys in the drive unit and around idler pulleys in the return unit. The assembly is suitable for transporting skiers, snowboarders and the like uphill at a variety of speeds while minimizing mechanical noise.

In addition to the electric motor and the power converter using a variable frequency drive, the portable drive unit includes a pair of drive pulleys that are each rotated by a belt driven by the electric motor. The portable drive unit also includes a pair of idler pulleys. The transport rope passes around each drive pulley and a respective idler pulley. The drive pulleys and the idler pulleys are aligned in a generally horizontal plane when the portable drive unit is set flat on a level surface. Also, the drive pulleys are desirably made of rubber and grooved, and the position of the idler pulleys with respect to the drive pulleys is such that the transport rope contacts the grooved drive pulleys for 180 degrees or more as the transport rope is driven around the respective grooved drive pulley. Desirably, the grooved drive pulleys of the portable drive unit also each have a groove cross section configured to receive a single wrap of rope and wedge the rope within the groove when the rope enters the respective drive pulley.

The return unit is located at the opposite end of the loop of transport rope and is normally installed on the downhill end of the assembly with the drive unit on the uphill end. The return unit has two laterally displaced idler pulleys on a frame in order to separate the uphill moving portion of the transport rope from the downward moving portion of the transport rope. While the return unit can staked or tethered in place when the rope tow assembly is in use, it is preferred to hold the frame and laterally displaced idler pulleys with straps and a steel cable come along that is staked or anchored in the snow or tethered to a stationary object like a tree. The come along is tightened to ensure sufficient tension is present on the transport rope to enable the drive unit to reliably drive the transport rope when the rope tow assembly is in use.

The portable rope tow assembly may also include a rope tensioner to reduce slack in the transport rope. The preferred tensioner is used at the return unit and uses a spring-biased idler wheel mounted between the laterally displaced pulleys. The transport rope passes on a proximal side of the spring biased idler wheel and around the distal sides of the laterally spaced pulleys. When a skier grabs the transport rope to be pulled up hill in front of the return unit at the bottom of a hill, for example, the rope can slack behind the skier if a tensioner is not used. The spring-biased tensioner takes this slack out of the transport rope and helps it pull smoothly.

The drive unit is desirably enclosed in a housing with integrated skid pan for easy movement over snow and lifting handles on the sides. The drive unit is held in place with snow stakes, or anchors that are installed under the snow. During set up, the continuous loop of transport rope is run down the hill to a 2-pulley return unit. The return unit is collapsible for easy transport. As mentioned, it uses straps or cable and securing device, such as a steel cable come along, to attach to a snow stake or anchor to hold it in place. The securing device takes up initial slack in rope, and can be mounted in line with a strain gauge to ensure that an appropriate amount of tension is present on the rope. The uphill moving side of the rope does not require any mid-support pulleys and therefore eliminates the need for special hooks or harnesses attached to the rope. The skier simply grabs onto the rope and has a clear unobstructed run back to the top of the hill. The downhill side of the rope can use guide stakes to keep the rope from dragging in the snow if desired.

All of the pulleys are in a horizontal position making it significantly easier to route the rope, which decreases setup time. The many of the components can be made of lightweight aluminum, which facilitates portability and set up. In addition, the drive unit components located in the housing are weather resistant, and the system is safer to operate because these moving parts are not exposed.

In addition, it is desirable to have a safety gate, and emergency off (EMO) switches (one at top of hill and one at the bottom) that cut power to the drive motor in the event of emergency. The safety gate is located on the uphill side rope, close to the drive unit, in a normal set up where the drive unit is positioned uphill of the return unit.

The invention has many advantages over prior art portable rope tow assemblies. One significant advantage is the use of the variable frequency drive with the electric motor and belt drive. Using the variable frequency drive enables the operator to control the speed of the transport rope as needed for the situation, e.g., from 0 mph to at least 13 mph. It also enables the operator, or a tripped safety gate, to stop the transport rope immediately without the need for an engine or motor to wind down.

Other features and advantages of the invention may be apparent to those skilled in the art after review the following drawings and description thereof.

DETAILED DESCRIPTION

Figure 1:
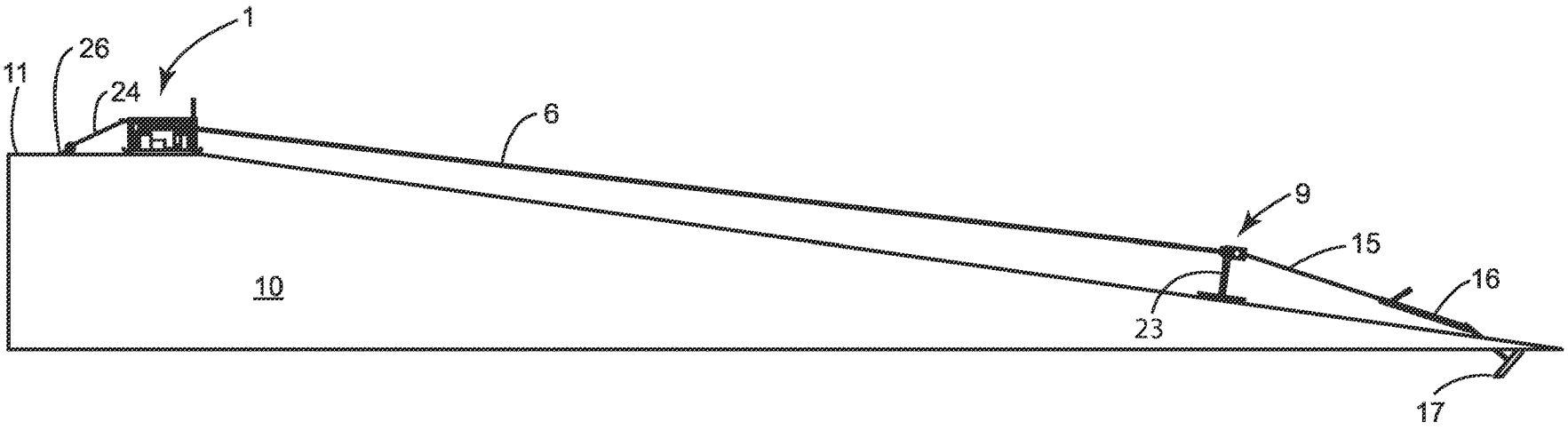
FIG. 1 is a side view depicting an incline where an exemplary embodiment of a portable rope tow assembly constructed in accordance with the invention is installed.
Figure 2:
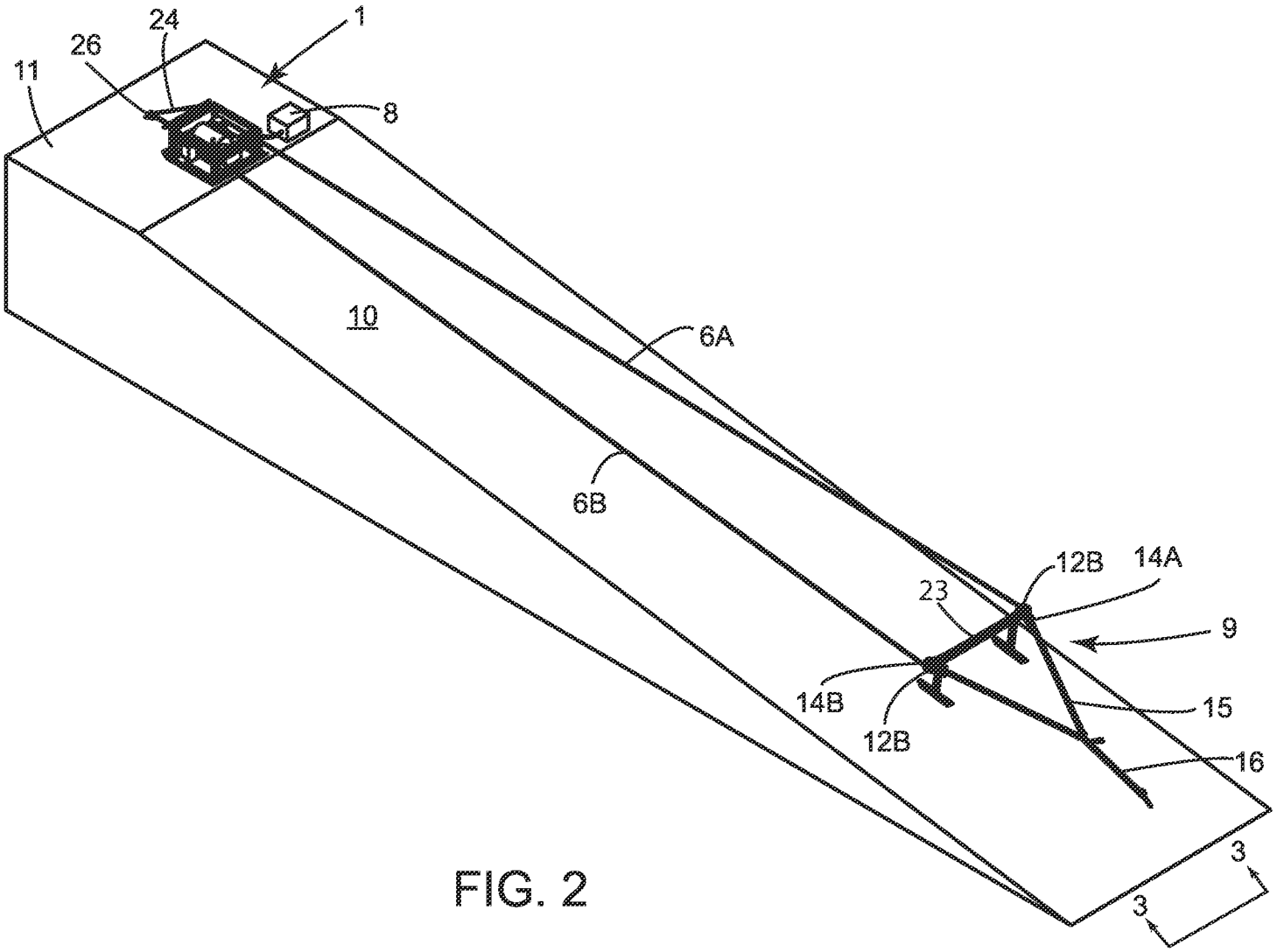
FIG. 2 is a perspective view of the exemplary portable rope tow assembly shown in FIG. 1
Figure 3:
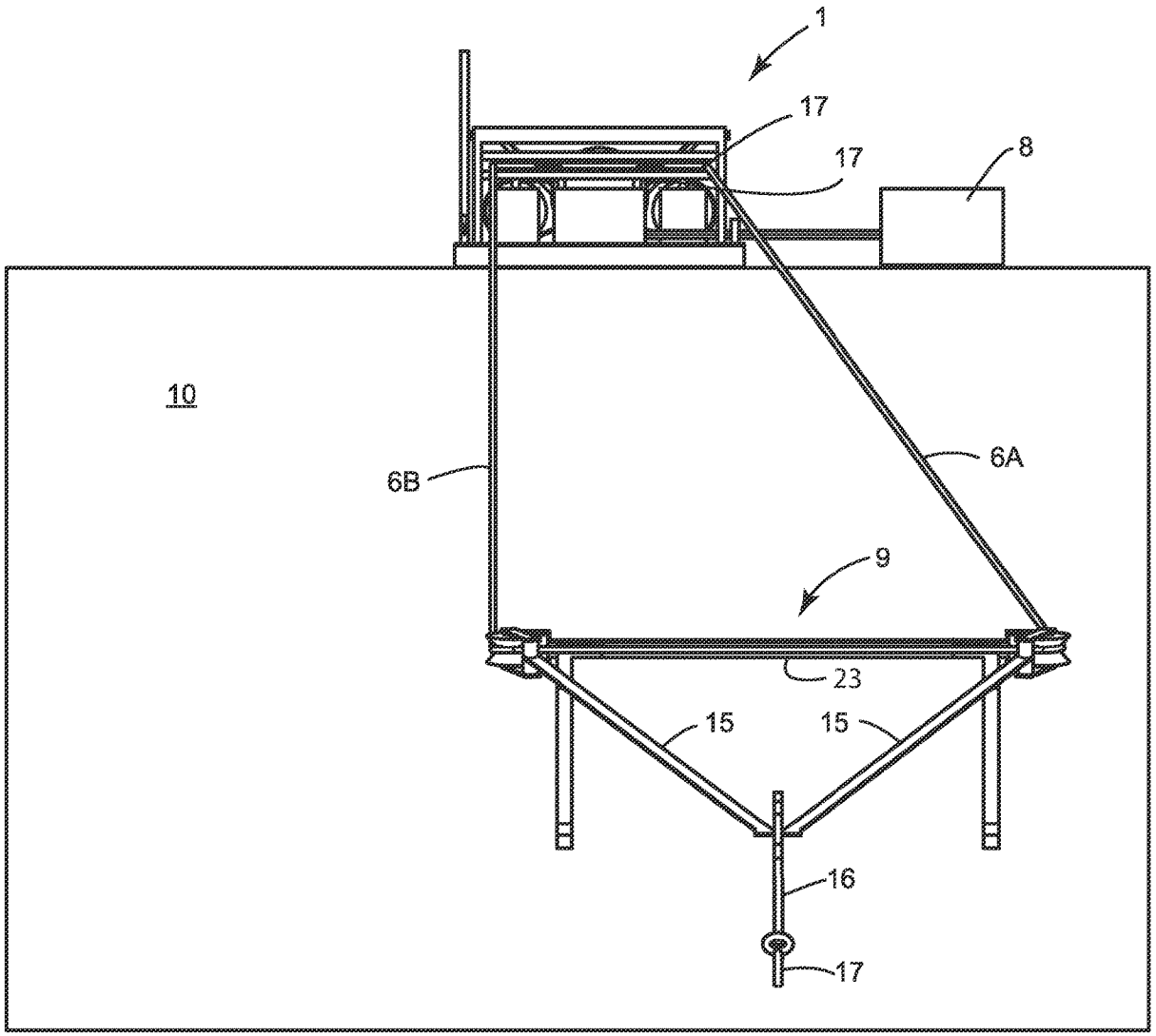
FIG. 3 is view taken from the direction of arrows 3-3 in FIG. 2.
Figure 4:
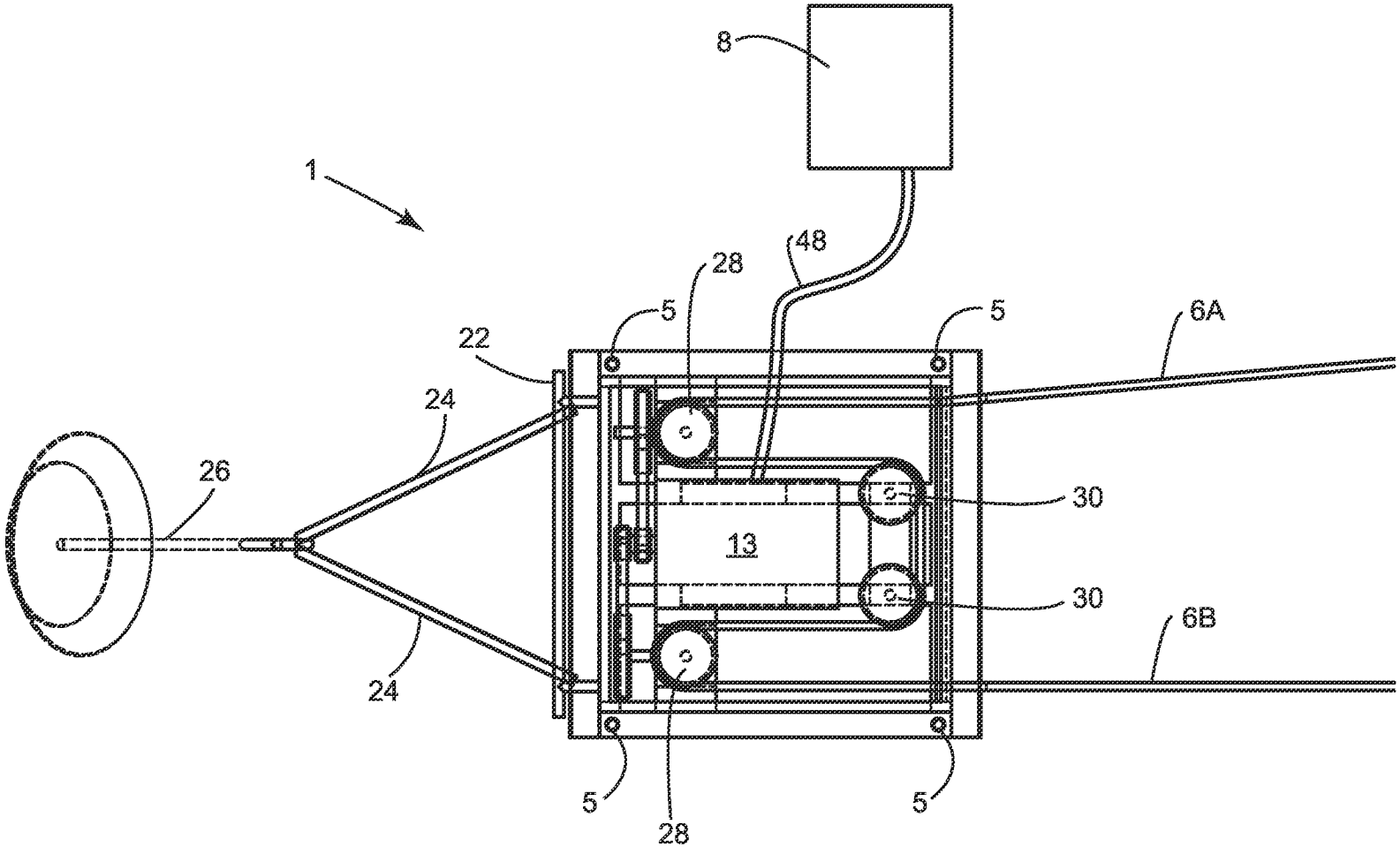
FIG. 4 is top view showing components of an exemplary drive unit as it typically is installed.

Referring first to FIGS. 1 through 3, a portable rope tow assembly constructed in accordance with the invention has a drive unit 1 that pulls a transport rope 6 and a return unit 9. The transport rope 6 provides mechanical means of transporting people, such as skiers, up an incline 10. The person being transported simply grabs on to the transport rope 6 while it is moving, and the person is moved along the path defined by transport rope 6. Transport rope 6 can be composed of various materials. In a preferred embodiment, either a synthetic (plastic) or natural fiber (or combinations thereof) rope is used. In a preferred embodiment, transport rope 6 is between 500 feet and 2500 feet in total length, with between 800 feet and 1800 feet being more highly preferred.

In FIGS. 1-3, the portable rope tow assembly is installed on the incline 10, e.g., a section of a run at a ski hill, as it is preferably installed with the drive unit 1 located on the uphill end and the return unit 9 located on the downhill end. The portable rope tow assembly can also be used on relatively flat surfaces, for example to move skiers and boarders at the bottom of a ski hill. It is possible that the portable rope tow could also be used to move people using wheeled equipment, like scooters, over surfaces that are not snow or ice covered, but the primary application of the invention is expected to be at ski resorts.

The drive unit 1 is secured to the top of the incline 10 (described in greater detail below), desirably on a relatively flat area 11, and provides power to pull the transport rope 6. The transport rope 6 connected between the drive unit 1 to the return unit 9 is a single, continuous loop. The transport rope 6 is depicted as a single line in FIG. 1; however, in FIGS. 2 and 3 reference number 6A designates the uphill moving side of the transport rope 6 and 6B designates the downhill moving side of the transport rope 6.

Figure 9:
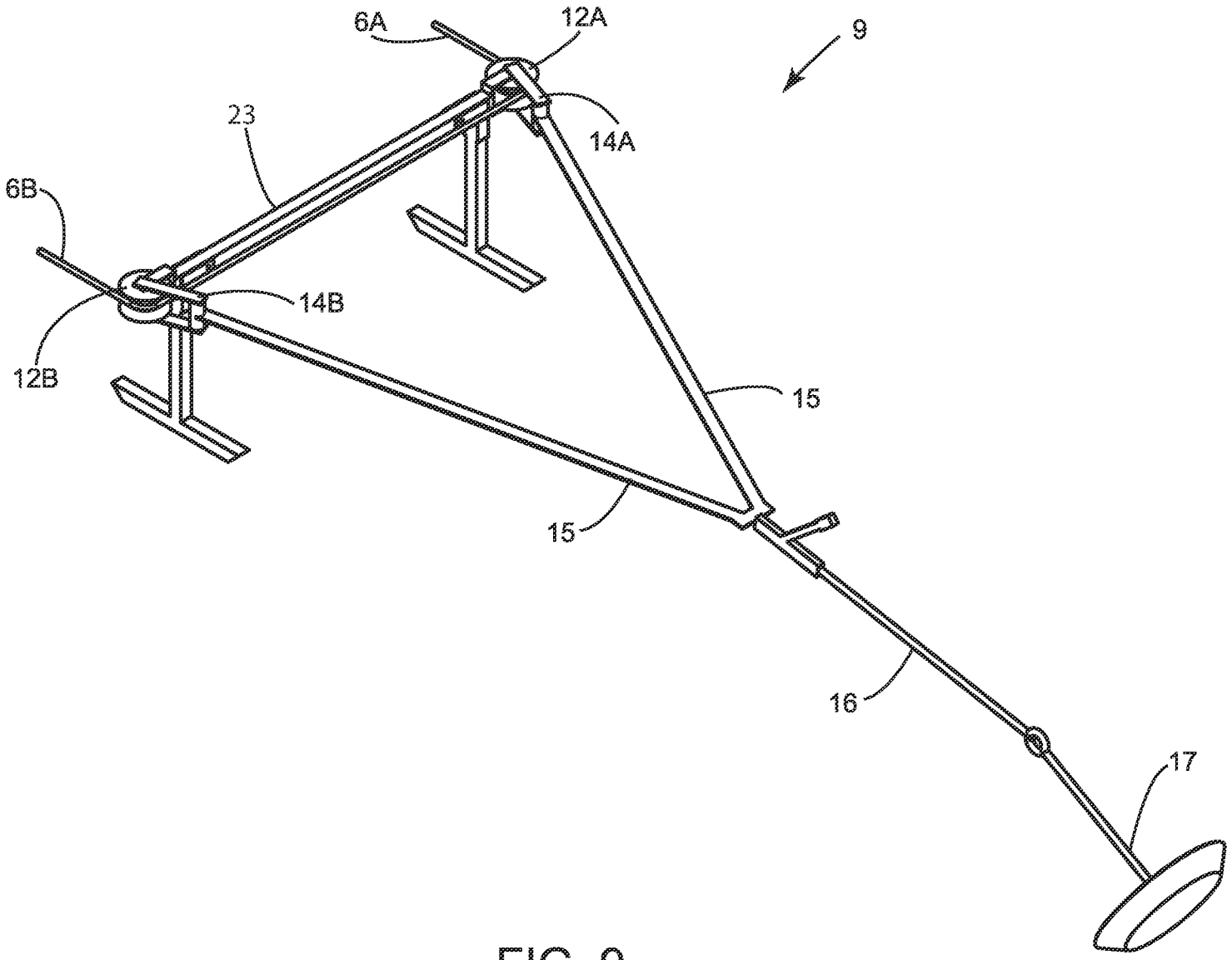
FIG. 9 is rear perspective view of the exemplary return unit as installed with straps, a steel cable come along and a snow anchor.

In a preferred embodiment, the return unit 9 has two idler pulleys 12A, 12B that are mounted generally horizontally on a frame 2 and separated by a distance to keep the uphill moving section 6A of the rope separated from the downhill moving section 6B of the transport rope. The return unit 9 is set up in order to provide tension to transport rope 6. Referring now also to FIG. 9, the frame 23 can be made of aluminum, which provides sufficient strength and is lightweight. Preferably, the legs on the frame 23 can collapse inward making the frame 2 easier to carry to and from the set up location. Strap connectors 14A, 14B are provided on the frame 2. In the exemplary embodiments, the strap connectors 14A, 14B are provide on the peripheral ends of the frame 2, and in particular by the use of hinged connector brackets 14A, 14B which share the same attachment axis as the respect idler pulley 12A, 12B. While there may be other ways to set up the assembly for operation, typically straps 15 are connected to a secured steel cable come along 16. The distal end of the come along 16 can be staked in the snow, or connected to a snow anchor 17 as shown in FIG. 1, or by tethering to a stationary object or tree. Once attached, the come along 16 is tightened to the desirable tensioning level, which can be measured using a strain gauge if desired. Other tensioners besides a come along can be used such as turnbuckle, or winch.

Although not shown in the drawings, guide bars can be driven into the ground underneath the downhill moving portion 6B of transport rope 6 to keep it from contacting the snow.

In an alternative set up, the positions of drive unit 1 and return unit 9 are reversed from that depicted in FIG. 1. Namely, the drive unit 1 is located at the lower end of incline 10 and return unit 9 located at the upper end of incline 10. Such a configuration may be desirable when surface conditions or terrain are more amenable to drive unit 1 being located at the lower end of incline 10.

Figure 7:
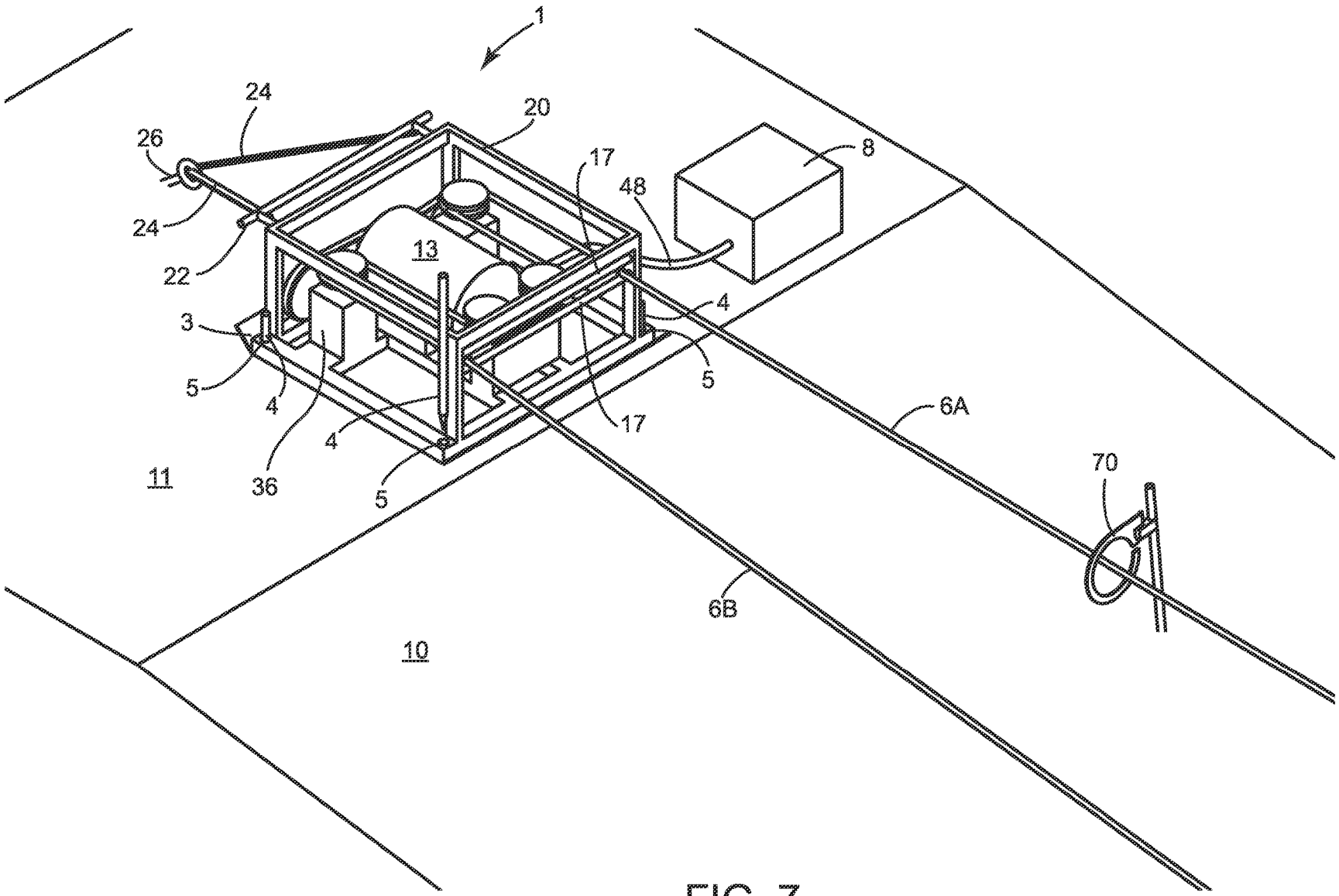
FIG. 7 is front perspective view of the exemplary drive unit as installed with a safety switch.

Exemplary components of the drive unit 1 and its operation are now described in connection with FIGS. 3-7. Referring first in particular to FIG. 7, many of the components of the drive unit 1 are contained in a housing 20 mounted on a skid plate 3. The housing 20 is fabricated, for example, as a welded or bolted frame assembly with plastic or metallic panels attached to keep out snow and debris. In the version of the housing shown in the drawings, the panels are made of transparent polycarbonate, which enables one to view the components within the housing. In principle, the housing frame 20 can be fabricated from any number of known structural materials including steel, plastic, wood, titanium, aluminum, etc. A preferred material is aluminum alloy which provides a good balance of strength and low weight. A handle 22 is affixed to the frame on the rear side of the housing 22 by either welding or bolting. Another handle 22 can be fixed to the frame at the front of the housing 20 to facilitate carrying and lifting, although this is not shown in the embodiment shown in the drawings.

The skid plate 3 is a continuous plate attached to the underside of drive unit 1 to aid in sliding drive unit 1 along the ground or snow covered surface. Skid plate 3 can be composed of any of the aforementioned structural materials. In a preferred embodiment, skid plate 3 is composed of plastic or aluminum, and in a highly preferred embodiment skid plate 3 is composed of plastic to minimize friction on the snow. Skid plate 3 can be welded, bolted or riveted to the frame of housing 20.

Hold down 5 holes pass through the peripheral base of the frame of the housing 20 and through the skid plate 3. This part of the frame resides outside of the housing side panels. The hold down holes 5 are configured to receive stakes 4 driven through hold down 5 holes into the underlying ground, which at a ski resort would normally be snow and ice. Suitable stakes are made of aluminum or steel and should have a length of 24 inches or more. The figures show the drive unit 1 being staked in to place, and also tethered with straps 24 connected to a snow anchor 26. It is not normally necessary to both stake and tether the drive unit 1. The drive unit 1 can also be tethered to a stationary object.

Although not shown in the drawings, the frame of the housing 20 can include hooks, as desired, in various locations. Frame hooks can be used to securing drive unit 1 to the top of incline 10 instead of the handle, or to serve as a location to aid in dragging drive unit 1 using a vehicle. Frame hooks 4 can be made of aluminum and welded to the peripheral base of the housing frame.

The transport rope 6 enters and exits drive unit 1 between horizontal guide bars 17 on a front side of the drive unit. As discussed in more detail below, the drive pulleys and idler pulleys in the drive unit 1 are mounted horizontally (or nearly horizontally) with respect to the housing frame and skid plate, and in a common plane so that the rope 6 is driven through the drive unit 1 in a common plane. The opening on the front of the drive unit 1 between the horizontal guide bars 17 is located within this plane. The guide bars 17 allow the tow rope system to operate at a wide range of vertical angles to accommodate various slopes of incline 10. Because the guide bars obviate the need for pulley alignment, the setup and take-down of tow rope system is simplified and expedited. The guide bars 17 can be composed of metal, plastic or wood. In a preferred embodiment, guide bars 17 are composed of a high hardness and/or corrosion resistant metal such as stainless steel to reduce wear.

Drive unit cover is desirably a transparent lid enclosing drive unit 1 while permitting observation of drive motor 13, transport rope 6 and pulley system contained in the housing. The transparent lid can be made of a variety of transparent materials such as transparent polycarbonate or acrylic. Drive unit cover 7 should be configured to be easy to remove and replace for rapid setup, take-down and repair if necessary. It is therefore contemplated that drive unit cover 7 be attached to the housing using screws or quick access fasteners such as wing nuts, magnetic fasteners, and the like.

Figure 5:
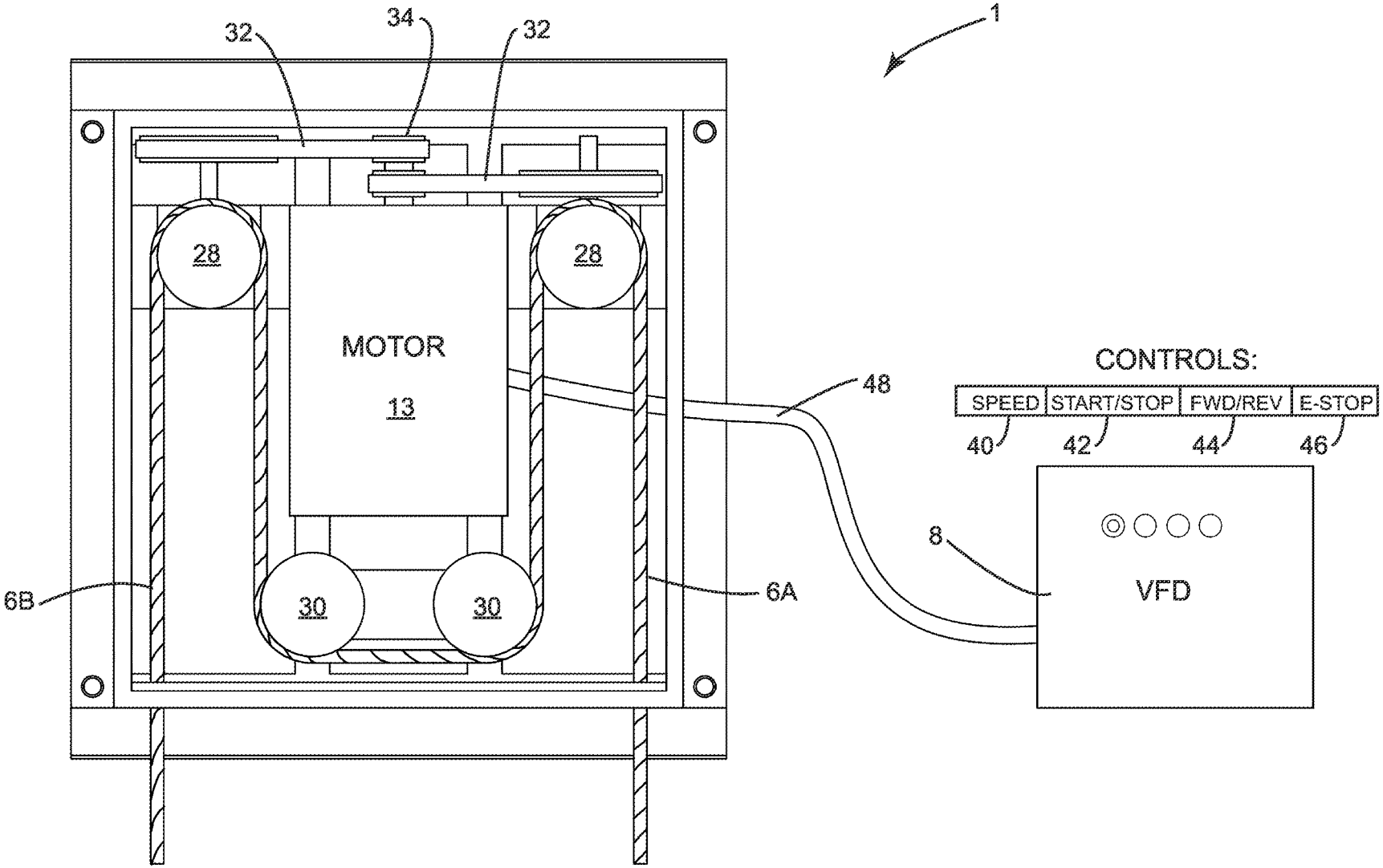
FIG. 5 is a detailed view showing components of the exemplary drive unit.
Figure 6:
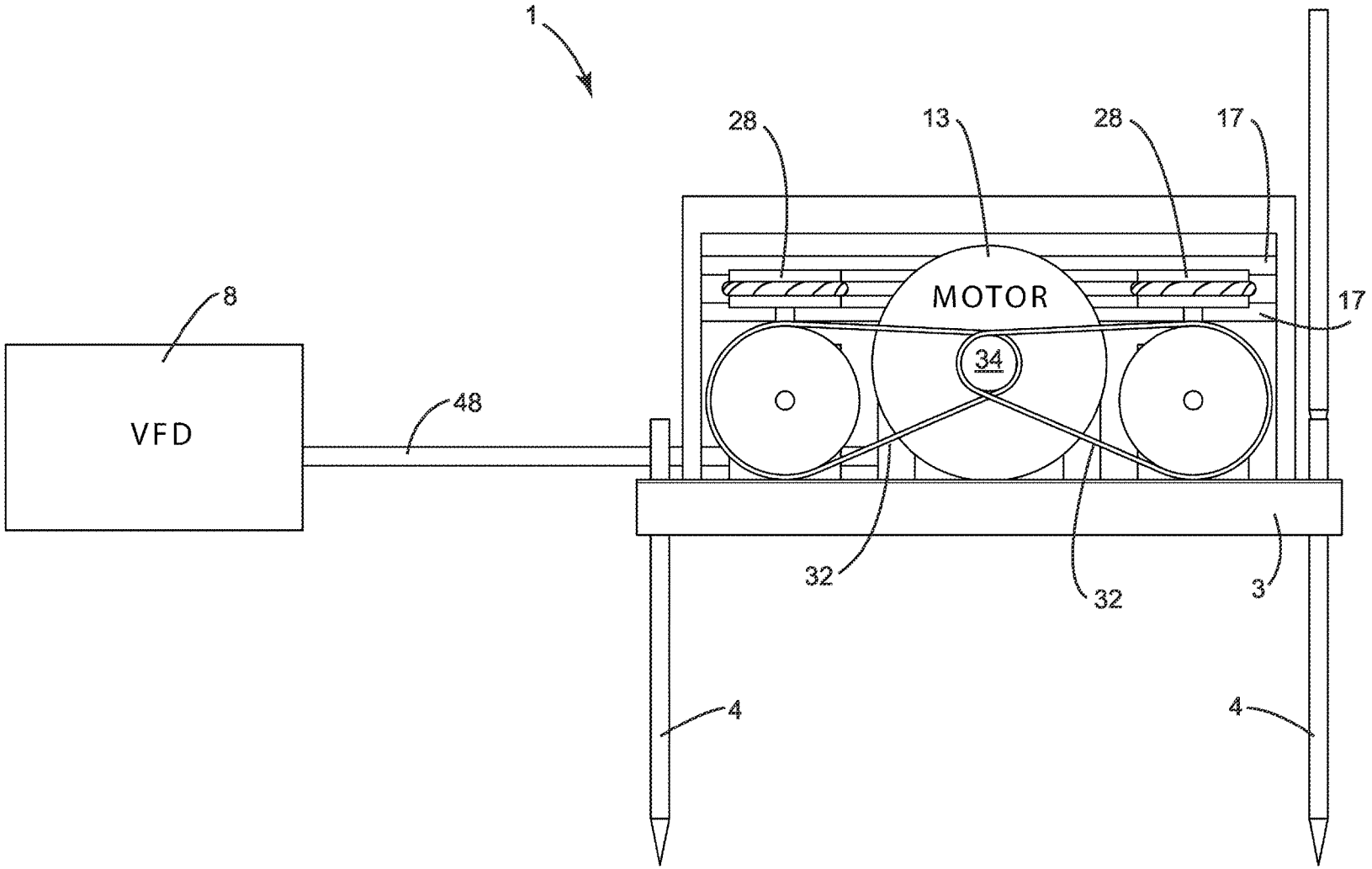
FIG. 6 is rear view of the exemplary drive unit.

Power converter 8 is used to convert alternating current (AC) line power into a variable frequency and/or variable power source for the AC drive motor 13. As depicted in FIG. 5, the power converter 8 includes motor speed control 40, start/stop control 42, forward/reverse control 44 and an emergency stop 46 control. It is desirable as mentioned that the speed of the rope be adjustable from 0 mph to about 13 mph in order to accommodate the variety of different conditions and situations that are likely to be encountered at a ski resort. Although not shown in the drawings, an additional emergency stop switch can be located near the return unit 9 (by running electrical wiring from the return unit 9 to drive unit 1). At the heart of power converter 8 is a class of solid-state power controllers referred to as a variable frequency drive (VFD). A VFD power controller not only permits motor speed control, but for many loading conditions. The VFD also increases motor efficiency thereby reducing the power requirement (and weight) of the motor 13. Power converter 8 is constructed using standard Si-based insulated gate bipolar transistors (IGBT) but the future use of much more compact and efficient SiC or GaN based controllers is contemplated herein. The VFD power converter 8 can receive input electrical power, normally 220 AC power, from a line run to the power converter 8 or from a generator set up nearby. The power converter 8 connects to the drive unit 1 and the drive motor 13 via a detachable cable 48. The controls on the VFD power converter are accessible outside of the drive unit housing 20. The VFD power converter 8 will typically be detached at days end, and taken for overnight storage, even if the rope tow assembly is otherwise left installed to operate on the ensuing day.

Referring now to FIG. 5, the components the inside the housing 20 of drive unit 1 are described. This exemplary drive unit 1 includes a drive motor 13, a pair of grooved drive pulleys 28, a pair of idler pulleys 30, drive belts 32 from the motor output shaft 34, and right angle gear boxes 36 (see FIG. 7) to transfer the power into the proper plane for the drive pulleys 28.

Drive motor 13 is an electrical motor which provides rotational power to propel the transport rope 6 though the system. Drive motor 13 can be an alternating current (AC) or direct current (DC) style motor. When drive motor 13 is an AC motor, it may be a single, or multi-phase motor. In the exemplary embodiment, the drive motor 13 is an AC motor with a power rating, e.g., from 3 to 40 horsepower (HP). The motor power output and gears are selected to determine the maximum top end speed of the rope. A 3 HP motor can be used with appropriate gearing for systems having a capacity of 3-5 skiers at a slow speeds. On the other hand, a 40 HP motor can be used for a system having a capacity of 22-25 skiers at relatively high speeds, such 13 mph or slightly less. As mentioned previously, a maximum top end speed of 13 mph should be sufficient for most applications.

Figure 8B:
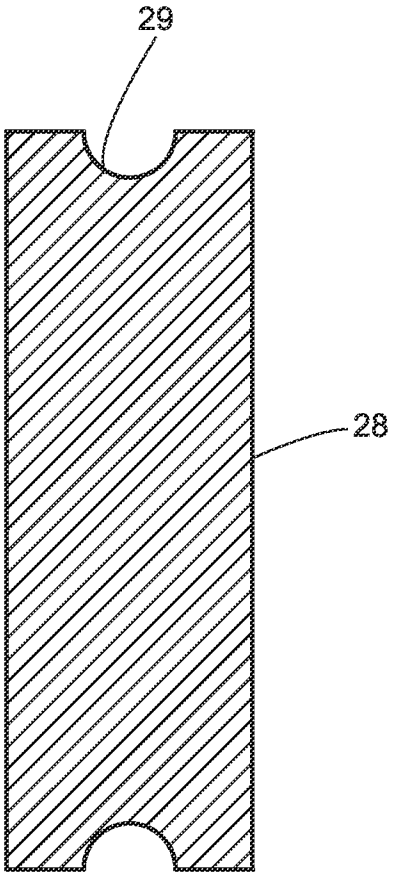
FIGS. 8A and 8B show the preferred geometry of the grooved drive pulleys.
Figure 8A:
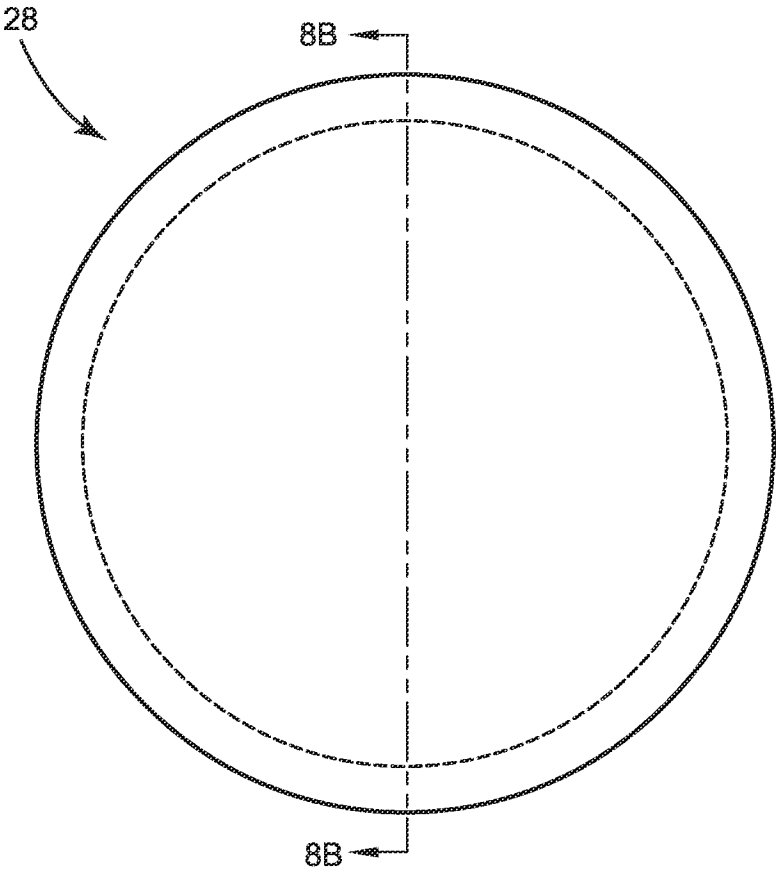

The input of gearboxes 36 are connected to the output shaft 34 of the drive motor 13 using belts 32. The gearboxes 36 are right angle style gearboxes whose output is connected to grooved pulleys 28 within which the transport rope 6 passes and is driven. Combinations of gearbox reduction and grooved pulley 28 diameter can be chosen to improve the pulling force of the transport rope 6 at the expense of velocity. Grooved pulleys 28 can be composed of a variety of materials (metal, plastic, etc.), however it has been found that rubber provides adequate and consistent adhesion to transport rope 6 during operation in snow. FIGS. 8A and 8B show an exemplary rubber drive pulley 28 and its cross section. The groove 29 in the pulley 28 is cut relatively deep in order to maximize surface area with the rope 6 as it is driven by the pulley 28. Essentially, the groove 29 is sized and configured to fully wedge the rope 6 within the groove 29 when the rope enters the respective drive pulley 28.

Idler pulleys 30 serve to maximize the contact area between transport rope 6 and grooved drive pulleys 28. By increasing the contact area between transport rope 6 and grooved pulleys 28, idler pulleys 30 permit greater pulling force before slippage occurs. As shown in FIG. 5, the drive pulleys 28 and idler pulleys 30 are positioned, desirably, so that the transport rope contacts the grooved drive pulleys 28 for 180 degrees or more as the transport rope 6 is driven around the respective grooved drive pulley 28.

Using a belt drive permits quiet and efficient mechanical coupling between the output shaft 34 of drive motor 13 and gearboxes 36 compared to chain-driven couplings. This benefit can be important during sports exhibitions and competitions when the added noise could detract from the show, or alternatively interfere with communication between personnel at the uphill and downhill stages of the lift.

Figure 10:
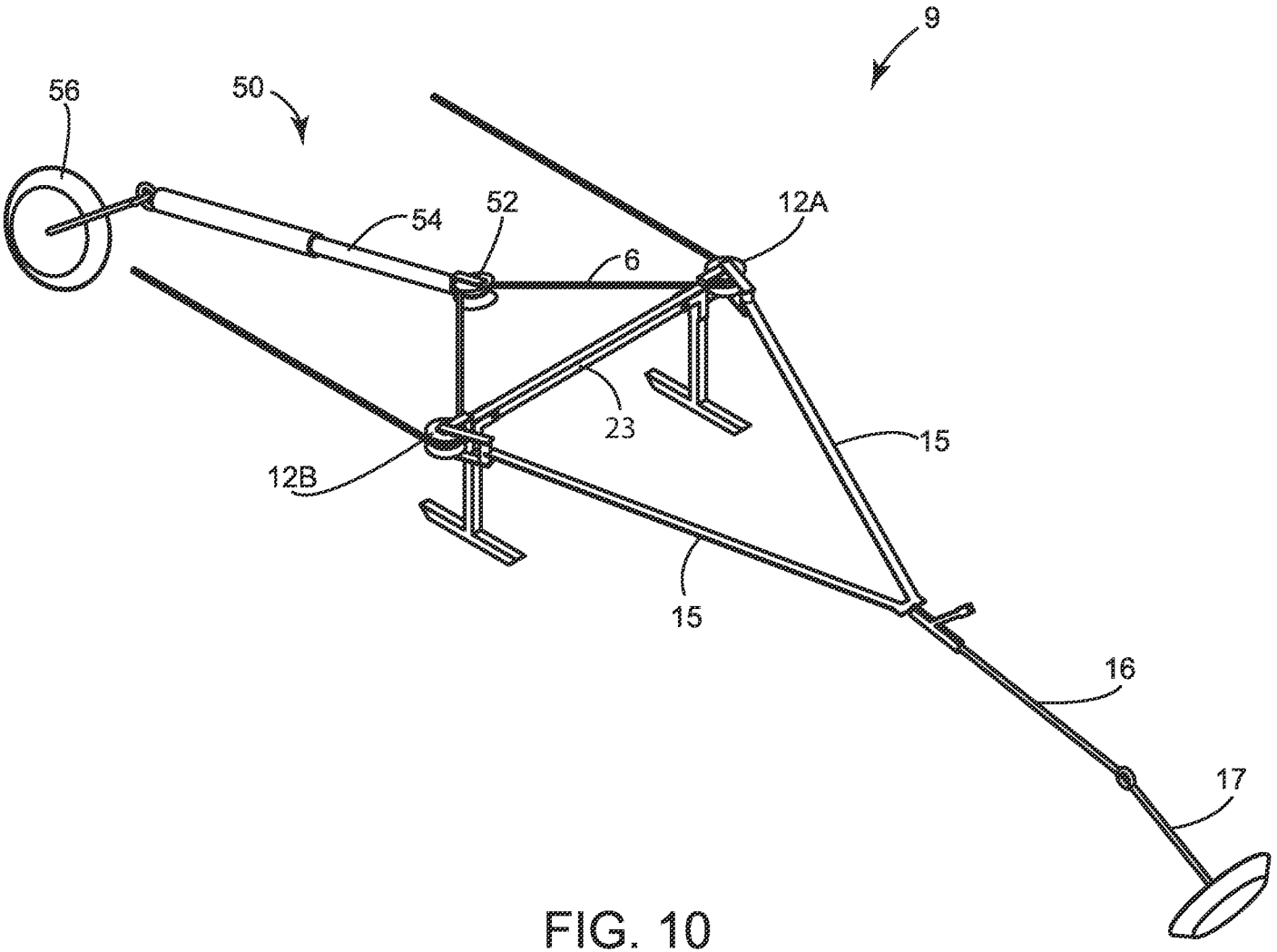
FIG. 10 is rear perspective view of the exemplary return unit similar that in FIG. 9, also showing the use of a spring-biased rope tensioner.

FIG. 10 shows an additional tensioner 50 to reduce slack in the transport rope 6, which can occur when a rider grabs the rope 6 to be propelled up hill. The tensioner 50 adds tension at the return unit 9 which is normally located on the downhill end of the rope tow assembly. The tensioner 50 has a spring-biased idler wheel 52 mounted between the laterally displaced pulleys 12A, 12B on the frame 23 of return unit 9. The transport rope 6 passes on a proximal side of the spring-biased idler wheel 52 and around the distal sides of the laterally spaced pulleys 12A, 12B. A spring mechanism, such as shock absorber 54, is attached between the tensioner idler wheel 52 and a stationary object such as a snow anchor 56 in FIG. 10.

Figure 11B:
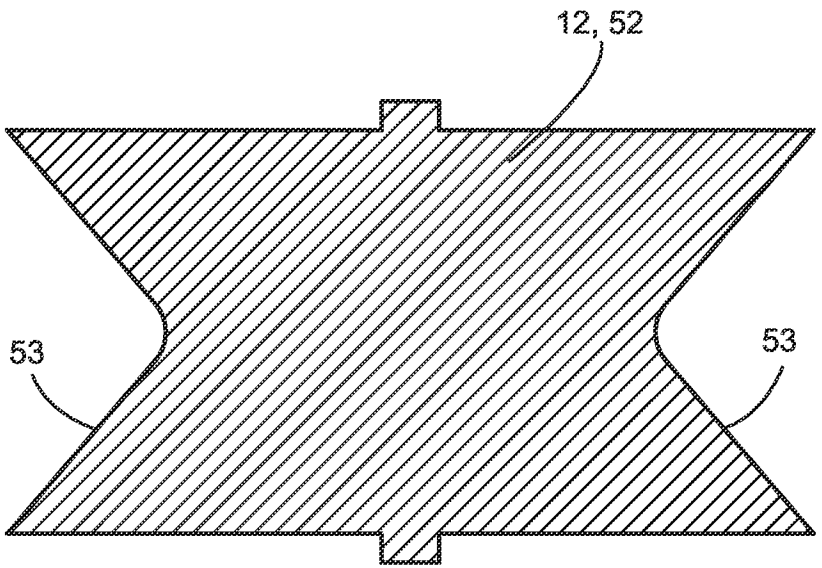
FIGS. 11A and 11B show the V-grooved pulleys used on the return unit and the tensioner to help prevent the rope from derailing.
Figure 11A:
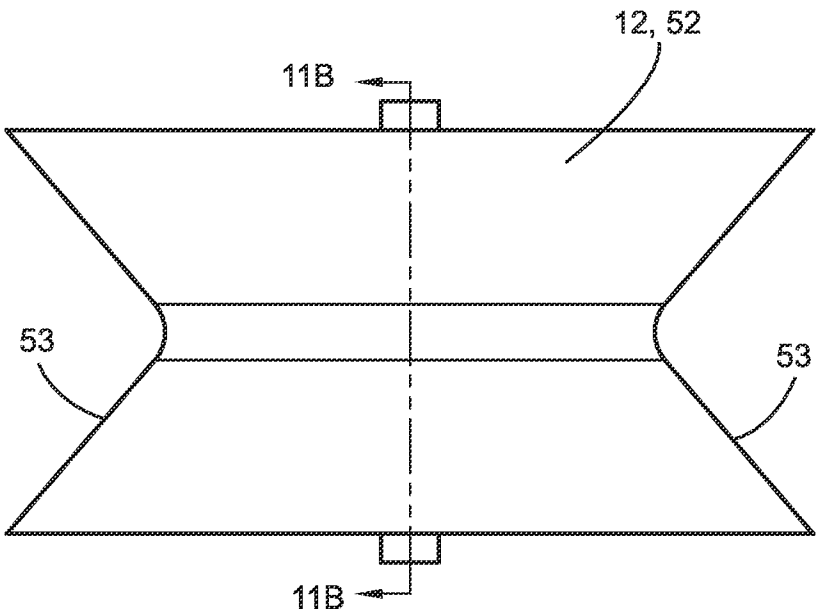

FIG. 11 shows a preferred geometry for the pulleys 12A, 12B on the return unit 9 and the spring-biased idler wheel 52 on the tensioner 50. The pulley wheels 12, 52 have a wide and deep V-groove 53. The V-groove 53 guides the rope into the center and deepest portion of the groove 53, which allows return pulleys 12A, 12B and the tensioner wheel 52 to function smoothly as long as the angle of the incoming does not exceed the angle of the respective V-groove surfaces 53. It has been found that the use of the V-groove pulleys 12 on the return unit 9 with the combination of tensioner 50 to reduce slack, and the use of the V-groove 53 on the tensioner wheel 52, effectively reduces the chance of the rope derailing during operation.

FIG. 7 shows a safety gate 70 on the uphill moving section 6A of the rope 6 prior to inputting the drive unit 1. In the event that there is an issue with a rider unable to let go of the rope 6, or if they do not let go of the rope at the appropriate time, they will contact the safety gate 70. The safety gate 70 is wired to the drive unit 1 via the variable frequency drive 8, and the motor 13 will shut down immediately when this occurs.

While the present application has been particularly shown and described with respect to preferred embodiments thereof, it will be understood by those skilled in the art that the foregoing and other changes in forms and details may be made without departing from the spirit and scope of the present application.

What is claimed is:

1. A portable rope tow assembly comprising:

a looped continuous transport rope;

a portable drive unit having an electric motor, an electric power converter comprising a variable frequency drive power controller, a pair of drive pulleys that are rotated by the electric motor and a pair of idler pulleys, wherein the transport rope passes around the drive pulleys and idler pulleys, and the drive unit is staked or tethered in place when the rope tow assembly is in use;

a drive unit housing in which the electric motor, the drive pulleys and the idler pulleys are contained, said electric power converter being located outside of the drive unit housing;

a return unit located at the opposite end of the loop of transport rope, said return unit including at least two laterally displaced pulleys in order to separate the uphill moving portion of the transport rope from the downward moving portion of the transport rope, wherein the return unit is staked or tethered in place when the rope tow assembly is in use;

wherein the electric power converter has operator controls that are accessible outside of the drive unit housing and a detachable cable is configured to connect the electric power converter to the drive motor such that the electric power converter is detachable from the drive motor and from the portable drive unit; and wherein there is sufficient tension on the transport rope when the rope tow assembly is in use to enable the drive unit to reliably drive the transport rope.

2. The portable rope tow assembly in claim 1 wherein the variable frequency drive power controller comprises a speed control mechanism that enables an operator to control the speed of the transport rope, a start/stop button, and an emergency stop button.

3. The portable rope tow assembly in claim 2 wherein the speed of the transport rope is variable from 0 mph to at least 13 mph.

4. The portable rope tow assembly in claim 2 further comprising a switch that controls the direction the drive unit drives the transport rope, thereby enabling forward and reverse movement of the transport rope.

5. The portable rope tow assembly in claim 1 further comprising:

a skid plate on which the housing is mounted.

6. The portable rope tow assembly in claim 1 wherein the laterally displaced pulleys of the return unit are horizontally oriented pulleys spaced apart laterally from one another, and mounted on a foldable frame.

7. The portable rope tow assembly in claim 1 wherein the drive unit and the return unit are tethered to snow anchors.

8. The portable rope tow assembly in claim 1 further comprising a first emergency shut off switch on the drive unit, and a second emergency shut off switch on the return unit.

9. The portable rope tow assembly in claim 1 further comprising a safety gate assembly prior to the rope intake for the drive unit.

10. A portable rope tow assembly comprising:

a looped continuous transport rope;

a portable drive unit having an electric motor, an electric power converter comprising a variable frequency drive power controller, a pair of drive pulleys that are rotated by the electric motor and a pair of idler pulleys, wherein the transport rope passes around the drive pulleys and idler pulleys, and the drive unit is staked or tethered in place when the rope tow assembly is in use;

a return unit located at the opposite end of the loop of transport rope, said return unit including at least two laterally displaced pulleys in order to separate the uphill moving portion of the transport rope from the downward moving portion of the transport rope, wherein the return unit is staked or tethered in place when the rope tow assembly is in use;

wherein there is sufficient tension on the transport rope when the rope tow assembly is in use to enable the drive unit to reliably drive the transport rope; and wherein each of the drive pulleys and the idler pulleys are aligned in a generally horizontal plane when the portable drive unit is set flat on a level surface.

11. The portable rope tow assembly in claim 10 wherein the portable drive unit further comprises a pair of horizontal guide bars on a side of the portable drive unit facing the return unit, wherein the horizontal guide bars guide the transport rope to the horizontal plane in which the drive pulleys and the idler pulleys operate.

12. The portable rope tow assembly in claim 10 wherein the drive pulleys are grooved and the transport rope contacts the grooved drive pulleys for 180 degrees or more as the transport rope is driven around the respective grooved drive pulley.

13. The portable rope tow assembly in claim 12 wherein the grooved pulleys of the portable drive unit each have a groove cross section configured to receive a single wrap of rope and wedge the rope within the groove when the rope enters the respective drive pulley.

14. The portable rope tow assembly in claim 13 wherein the grooved drive pulleys are made of rubber.

15. A portable rope tow assembly comprising:

a looped continuous transport rope;

a portable drive unit having an electric motor, an electric power converter comprising a variable frequency drive power controller, a pair of drive pulleys that are rotated by the electric motor and a pair of idler pulleys, wherein the transport rope passes around the drive pulleys and idler pulleys, and the drive unit is staked or tethered in place when the rope tow assembly is in use;

a return unit located at the opposite end of the loop of transport rope, said return unit including at least two laterally displaced pulleys in order to separate the uphill moving portion of the transport rope from the downward moving portion of the transport rope, wherein the return unit is staked or tethered in place when the rope tow assembly is in use;

wherein there is sufficient tension on the transport rope when the rope tow assembly is in use to enable the drive unit to reliably drive the transport rope; and wherein the electric motor drives a pair of gear boxes which are each connected to one of the respective drive pulleys, and an output shaft of the electric motor is connected to the gear boxes with a belt drive.

16. The portable rope tow assembly in claim 15 further comprising a tensioner to reduce slack in the transport rope.

17. The portable rope tow assembly in claim 16 wherein the tensioner comprises a spring-biased idler wheel mounted between the laterally displaced pulleys such that the transport rope passes on a proximal side of the spring biased idler wheel and around the distal sides of the laterally spaced pulleys.

18. The portable rope tow assembly in claim 17 wherein the laterally displaced pulleys on the return unit and the spring-biased idler wheel on the tensioner each have a V-groove.

19. The portable rope tow assembly in claim 15 wherein the portable drive unit is mounted uphill of the return unit.

20. The portable rope tow assembly in claim 15 wherein the laterally displaced pulleys on the return unit each have a V-groove.

* * * * *